US011897086B2

(12) United States Patent
Park et al.

(10) Patent No.: US 11,897,086 B2
(45) Date of Patent: Feb. 13, 2024

(54) WINDOW FOR DISPLAY APPARATUS, MANUFACTURING METHOD THEREOF, AND MANUFACTURING METHOD OF DISPLAY APPARATUS

(71) Applicant: Samsung Display Co., Ltd., Yongin-Si (KR)

(72) Inventors: Cheolmin Park, Hwaseong-si (KR); Hoikwan Lee, Suwon-si (KR); Seung Kim, Seongnam-si (KR); Jaejoong Kwon, Suwon-si (KR); Eun-kyung Yeon, Suwon-si (KR); Minsoo Kim, Seoul (KR); Seungho Kim, Asan-si (KR); Jong-hoon Yeum, Seoul (KR)

(73) Assignee: Samsung Display Co., Ltd., Yongin-Si (KR)

( * ) Notice: Subject to any disclaimer, the term of this patent is extended or adjusted under 35 U.S.C. 154(b) by 862 days.

(21) Appl. No.: 16/931,316

(22) Filed: Jul. 16, 2020

(65) Prior Publication Data

US 2020/0346314 A1 Nov. 5, 2020

Related U.S. Application Data

(62) Division of application No. 15/435,234, filed on Feb. 16, 2017, now Pat. No. 10,722,995.

(30) Foreign Application Priority Data

Feb. 24, 2016 (KR) ..... 10-2016-0022094

(51) Int. Cl.
*B32B 3/26* (2006.01)
*B32B 3/30* (2006.01)
(Continued)

(52) U.S. Cl.
CPC ..... *B24B 7/10* (2013.01)

(58) Field of Classification Search
CPC .... H05K 5/03; H10K 2103/311; H10K 77/10; H10K 77/111; B32B 3/26; B32B 3/263; B32B 3/30; G06F 1/1652; G06F 1/1641
See application file for complete search history.

(56) References Cited

U.S. PATENT DOCUMENTS 1,785,401 A 12/1930 Emanuel
4,131,103 A 12/1978 Ishizuka
(Continued)

FOREIGN PATENT DOCUMENTS

JP 5472521 B1 4/2014
JP 5510693 B1 6/2014
(Continued)

*Primary Examiner* — Joanna Pleszczynska
(74) *Attorney, Agent, or Firm* — Innovation Counsel LLP

(57) ABSTRACT

A method of manufacturing a window for a display apparatus according to the present invention includes: providing, on a stage, a substrate including a foldable part bending around a folding axis extending in a first direction, and forming a groove on the foldable part. The forming the groove includes: grinding the foldable part by using a first machining wheel; grinding the foldable part by using a second machining wheel; and machining the foldable part by using a polishing wheel. The groove has at least one radius of curvature. The first machining wheel includes first abrasive grains, and the second machining wheel includes second abrasive grains less in size than the first abrasive grains.

6 Claims, 10 Drawing Sheets

(51) Int. Cl.

| | |
|---|---|
| ***G06F 1/16*** | (2006.01) |
| ***H05K 5/03*** | (2006.01) |
| ***H10K 77/10*** | (2023.01) |
| ***B24B 7/10*** | (2006.01) |

(56) References Cited

U.S. PATENT DOCUMENTS

| | | | | |
|---|---|---|---|---|
| 5,409,416 | A | 4/1995 | Eichhorn et al. | |
| 7,404,756 | B2 | 7/2008 | Ourderkirk et al. | |
| 8,531,764 | B2 | 9/2013 | Park | |
| 9,625,368 | B2 | 4/2017 | Goodwin et al. | |
| 9,645,613 | B2 | 5/2017 | Nam et al. | |
| 2006/0094340 | A1 | 5/2006 | Ouderkirk et al. | |
| 2014/0376162 | A1 | 12/2014 | Lim et al. | |
| 2015/0049428 | A1* | 2/2015 | Lee | G06F 1/1652 361/679.27 |
| 2015/0357387 | A1 | 12/2015 | Lee et al. | |

FOREIGN PATENT DOCUMENTS

| | | | |
|---|---|---|---|
| KR | 10-2006-0032982 | A | 4/2006 |
| KR | 10-2011-0000308 | A | 1/2011 |
| KR | 10-2011-0008486 | A | 1/2011 |
| KR | 10-1057151 | B1 | 8/2011 |
| KR | 10-20120069619 | A | 6/2012 |
| KR | 10-2013-0007068 | A | 1/2013 |
| KR | 20130000998 | A | 1/2013 |
| KR | 10-1238214 | B1 | 3/2013 |
| KR | 20130106408 | A | 9/2013 |
| KR | 10-1411015 | A | 6/2014 |
| KR | 10-2014-0125478 | A | 10/2014 |
| KR | 20150000553 | A | 1/2015 |
| KR | 10-2015-0027956 | A | 3/2015 |
| KR | 10-2015-0051042 | A | 5/2015 |
| KR | 10-20150108990 | A | 10/2015 |
| KR | 10-2015-0140501 | A | 12/2015 |

* cited by examiner

WINDOW FOR DISPLAY APPARATUS, MANUFACTURING METHOD THEREOF, AND MANUFACTURING METHOD OF DISPLAY APPARATUS

CROSS-REFERENCE TO RELATED APPLICATION(S)

This application is divisional application of U.S. patent application Ser. No. 15/435,234 filed Feb. 16, 2017, which claims priority under 35 U.S.C. § 119 of Korean Patent Application No. 10-2016-0022094, filed on Feb. 24, 2016, the entire contents of which are hereby incorporated by reference.

BACKGROUND

The present disclosure relates to a display apparatus, and more particularly, to a window for a display apparatus, a manufacturing method thereof, and a manufacturing method of a display apparatus.

A liquid crystal display apparatus (LCD), a plasma display panel (PDP), a field emission display apparatus (FED), a light emitting diode display apparatus, and an organic light emitting diode display apparatus are some of the known flat panel type display apparatuses.

The aforementioned display apparatuses may be used as display apparatuses for mobile devices such as a smartphone, a digital camera, a camcorder, a portable information terminal, an ultra slim lap top, and a tablet personal computer, or used in electrical and electronic products such as an ultra thin type television set, etc.

Recently, a flexible display device which is highly portable and applicable to devices having various shapes is highlighted as a next generation display apparatus.

SUMMARY

The present disclosure provides a window for a display apparatus capable of being folded without damage, a manufacturing method thereof, and a manufacturing method of the display apparatus.

An embodiment of the inventive concept provides a manufacturing method of a window for a display apparatus including providing a substrate on an upper portion of a stage and forming a groove. The method may further include etching the substrate to reduce the thickness of the substrate and chemically reinforcing the substrate. A manufacturing method for a display apparatus according to an embodiment of the inventive concept further includes attaching a display panel in addition to the manufacturing method for a window for a display apparatus.

In an embodiment, the substrate may include a foldable part being bent along a first direction and a flat part adjacent to the foldable part. The substrate may have a curved shape along the first direction. A first surface of the substrate may contact the stage, and a second surface of the substrate may be opposed to the first surface.

In an embodiment, the forming a groove may include: grinding the foldable part by using a first machining wheel including first abrasive grains; grinding the foldable part by using a second machining wheel including second abrasive grains that are less than the first abrasive grains; and machining edges formed on the foldable part by using a polishing wheel. The forming a groove may be grinding the foldable part with a machining wheel to form a groove having at least one radius of curvature.

Each of the first and second machining wheels may rotate about a rotating axis that extends in a second direction intersecting the first direction. Alternatively, each of the first and second machining wheels may rotate about a rotating axis that extends parallel to the first direction.

The first machining wheel may have a first radius of curvature defined in a plane perpendicular to the first direction. The grinding of the foldable part by using the first machining wheel may be forming a first grinding surface having the first radius of curvature on the foldable part, forming a first edge on one end of the first grinding surface, and forming a second edge on the other end of the first grinding surface. The grinding the foldable part by using the first machining wheel may determine a minimum thickness of the foldable part.

The second machining wheel may have a second radius of curvature greater than the first radius of curvature. In this case, the grinding of the foldable part by using the second machining wheel may include grinding of the first and second edges with the second machining wheel to form second and third grinding surfaces having the second radius of curvature.

The second machining wheel may have a third radius of curvature less than the first radius of curvature. In this case, the grinding the foldable part by using the second machining wheel may include grinding the first edge with the second machining wheel to form a second grinding surface having the third radius of curvature and grinding the second edge with the second machining wheel to form a third grinding surface having the third radius of curvature.

Each of the first and second machining wheels may have a plurality of radii of curvature. Each of the first and second machining wheels may have the same shape.

The attaching the display panel may be performed such that the second surface is attached more closely to the display panel than the first surface. In this case, the manufacturing method of the display apparatus may further include filling a buffering member in the groove.

The attaching the display panel may be performed such that the first surface is attached more closely to the display panel than the second surface. In this case, the second surface may include a groove surface forming the groove, and the groove surface may have a plurality of radii of curvature. One end and the other end of the groove surface may have a minimum radius of curvature, respectively. The groove surface may be formed to have at least one minimum radius of curvature between the one end and the other end.

BRIEF DESCRIPTION OF THE FIGURES

The accompanying drawings are included to provide a further understanding of the inventive concept, and are incorporated in and constitute a part of this specification. The drawings illustrate exemplary embodiments of the inventive concept and, together with the description, serve to explain principles of the inventive concept. In the drawings.

DETAILED DESCRIPTION

Figure 1:
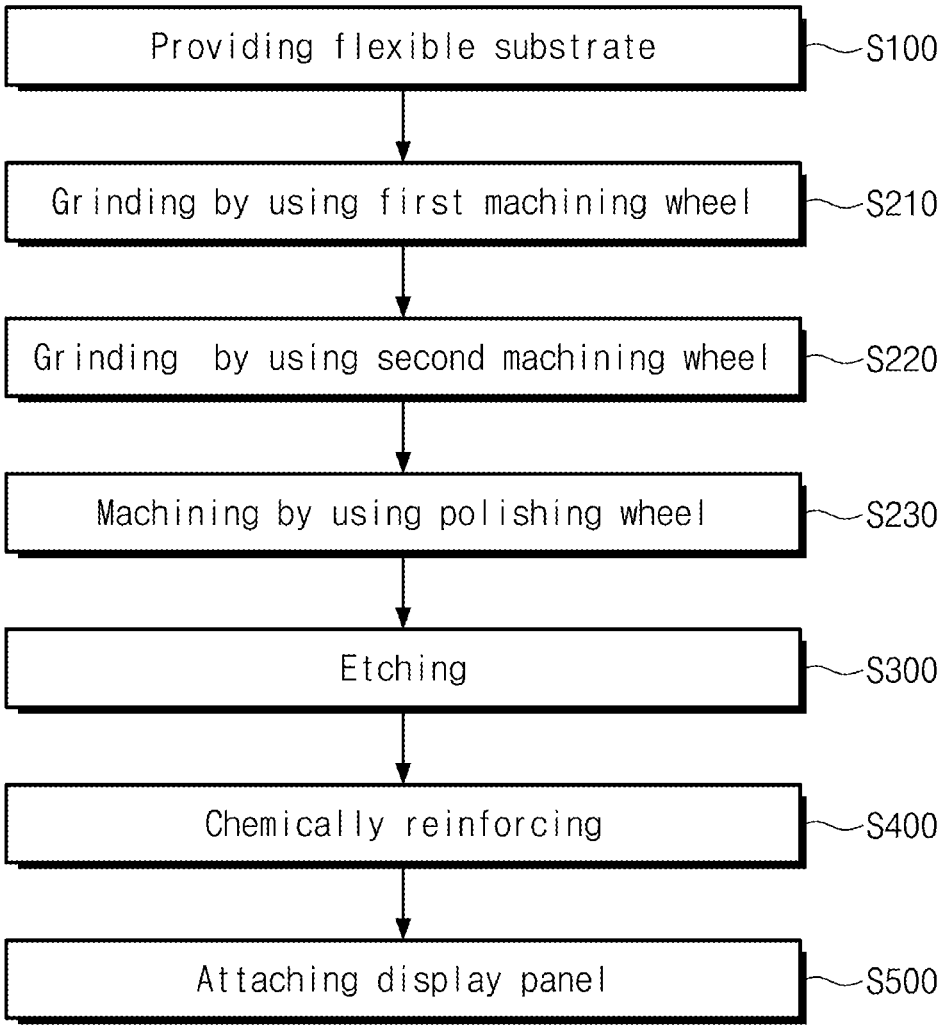
FIG. 1 is a flowchart illustrating a manufacturing method of a display apparatus according to an embodiment of the inventive concept.

The embodiments according to the inventive concept may be variously modified and may have multiple forms, and thus specific embodiments are illustrated in the drawings or described in detail in this specification. However, this is not intended to limit the inventive concept to the specific embodiments, rather it should be understood that all of variations, equivalents or substitutes contained in the concept and technical scope of the present invention are also included.

FIG. 1 is a flowchart illustrating a method of manufacturing a display apparatus 1000 according to an embodiment of the inventive concept.

Referring to FIG. 1, FIG. 2, FIG. 10, and FIG. 11, the method of manufacturing the display apparatus 1000 includes: providing a flexible substrate 100 (S100); forming a groove 110 on the substrate 100 (S200); etching the substrate 100 to reduce the thickness thereof (S300); chemically reinforcing (S400); and attaching the substrate 100 and a display panel 500 (S500). The forming the groove 110 (S200) includes: grinding a foldable part FA by using a first machining wheel 310 (S210); grinding the foldable part FA by using a second machining wheel 320 (S220); and machining an edge formed on the foldable part FA by using a polishing wheel 330 (S230).

The providing the flexible substrate 100 (S100) is providing the substrate 100 on an upper portion of a stage 200. The stage 200 fixes the substrate 100 so as to facilitate machining of the substrate 100. The substrate 100 plays a role in preventing damage to the display panel 500 due to factors, such as fingerprints, scratch, moisture and dusts that are caused by touch, or external impact. If the thickness of the substrate 100 is too thin, the substrate 100 is likely to be broken by a small impact, and the impact may be easily transmitted to the display panel 500. Thus, the substrate 100 needs to have a thickness equal to or greater than a predetermined thickness.

The substrate 100 may include an insulation material having elasticity. The substrate 100 may be transparent or translucent. The substrate 100 may include a glass substrate. Also, the substrate 100 may include a polymer material such as polyimide (PI), polycarbonate (PC), polyethersulphone (PES), polyethylene terephthalate (PET), polyethylenenaphthalate (PEN), polyarylate (PAR) or fiber glass reinforced plastic (FRP).

The forming the groove 110 on the substrate 100 (S200) is reducing the thickness of the foldable part FA to secure folding characteristics of the substrate 100. Detailed description thereof will be provided below.

The etching (S300) is reducing the thickness of the substrate 100 by using an etching solution or the like. The etching (S300) is etching the entire substrate 100. That is, the etching (S300) is also etching a flat part NFA as well as etching the foldable part FA, thereby reducing the thickness of the entire substrate 100.

The etching of the substrate 100 is not limited to any one type, and in another embodiment, the substrate 100 may be etched by a wet etching such as a dip type, a spray type or a down-flow type etching.

The chemical reinforcing (S400) includes replacing ions of the substrate 100 with other ions. For example, when the substrate 100 including glass is dipped in a hot molten alkali salt, a part of sodium ions ($Na^+$) on the surface of the substrate 100 are exchanged with potassium ions ($K^+$). The potassium ion ($K^+$) is greater in size than the sodium ion (Na+), and forms a compressive stress layer upon cooling, thereby increasing strength of the substrate 100.

Figure 2:
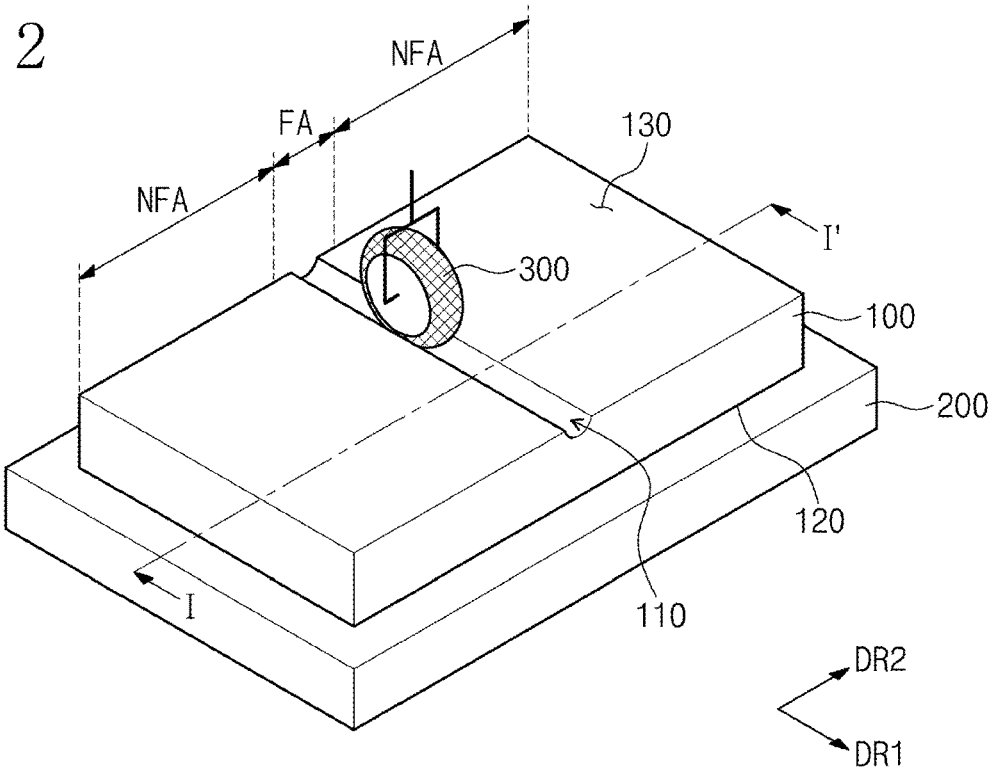
FIGS. 2 and 3 are perspective views illustrating forming a groove on a substrate.
Figure 3:
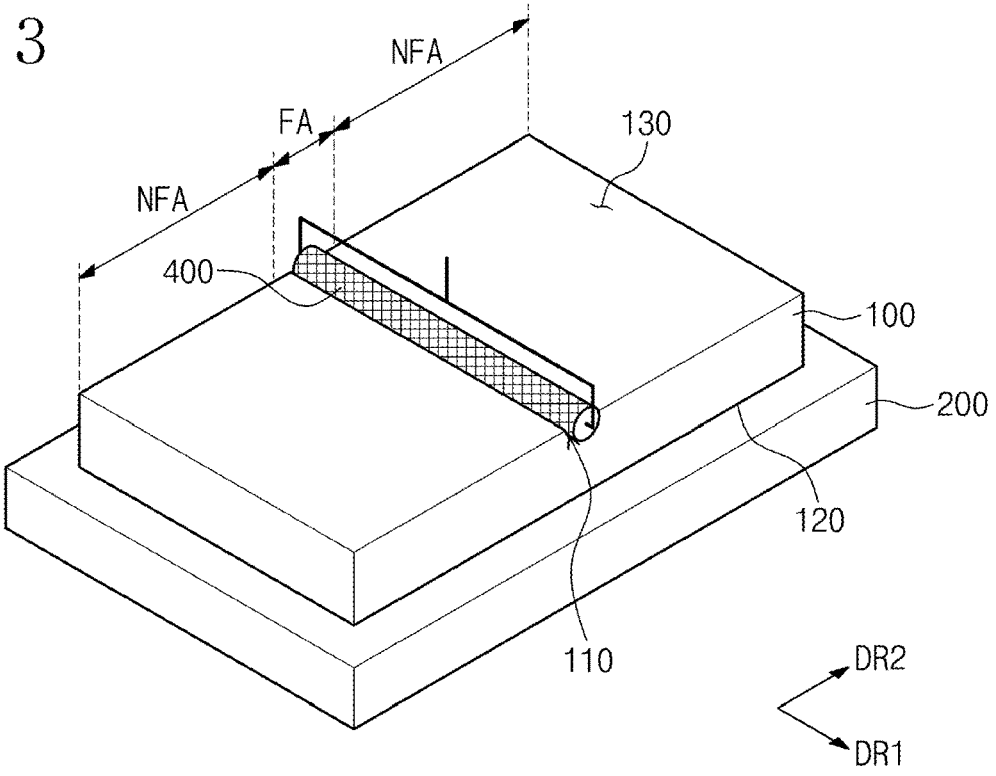

FIGS. 2 and 3 are perspective views illustrating forming a groove 110 on a substrate 100 (S200).

Referring to FIGS. 2 and 3, the substrate 100 includes a foldable part FA being bent along a first direction DR1, a flat part NFA adjacent to the foldable part FA, a first surface 120 contacting a stage 200, and a second surface 130 opposed to the first surface 120 and ground by machining wheels 300 and 400.

The foldable part FA is bent in a second direction DR2 intersecting the first direction DR1 along the line parallel to the first direction DR1. The foldable part FA may be bent such that right and left portions of the first surface 120 more closely face each other than the second surface 130, or right and left portions of the second surface 130 more closely faces each other than the first surface 120.

Folding characteristics of the substrate 100 are affected by the thickness of the substrate 100 and the radius of curvature due to bending. Specifically, as the thickness of the substrate 100 increases, the magnitude of tensile stress increases, and as the substrate 100 is further bent to have a smaller radius of curvature, the magnitude of the tensile stress increases. That is, the thickness of the substrate 100 needs to be reduced in order to improve the folding characteristics.

In order to improve the folding characteristics of the substrate 100, the groove 110 may be formed on the foldable part FA such that the thickness of the substrate 100 is reduced. In this case, the stress may be induced to be concentrated on the foldable part FA while minimizing influence on the flat part NFA. Thus, damage to the substrate 100 due to bending of the substrate 100 is prevented. Also, the thickness of the flat part NFA is formed to be greater than the thickness of the foldable part FA, so that the resistance of the substrate 100 against impact may be secured.

The forming of the groove 110 (S200) entails grinding the foldable part FA with the machining wheels 300 and 400 to form the groove 110 defined in a plane perpendicular to the first direction DR1 and having at least one radius of curvature.

The machining wheel 300 of FIG. 2 rotates using the second direction DR2 as the axis of rotation and moving along the first direction DR1 to form the groove 110. The machining wheel 400 of FIG. 3 rotates about the first direction DR1 as a rotation axis to form the groove 110.

Both of the machining wheels 300 and 400 of FIG. 2 may form the groove 110 having one radius of curvature. However, the machining wheel 400 of FIG. 3 rotates about the first direction DR1 as the rotation axis to form the groove 110, and thus the machining wheel 400 is unable to form the groove 110 having a plurality of radii of curvature such as an elliptical shape. Thus, it is preferred to grind the foldable part FA using the machining wheel 300 of FIG. 2 to form the groove 110 having the plurality of radii of curvature, such as the elliptical shape.

Figure 4A:
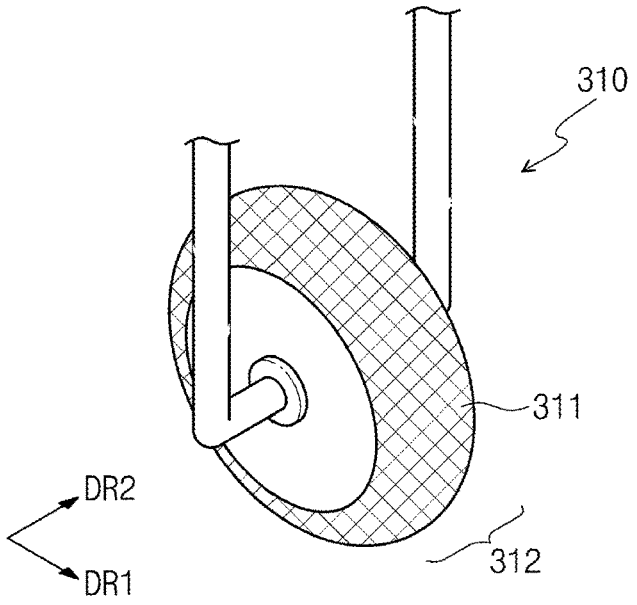
FIG. 4A is a perspective view illustrating a first machining wheel of FIG. 2.
Figure 4B:
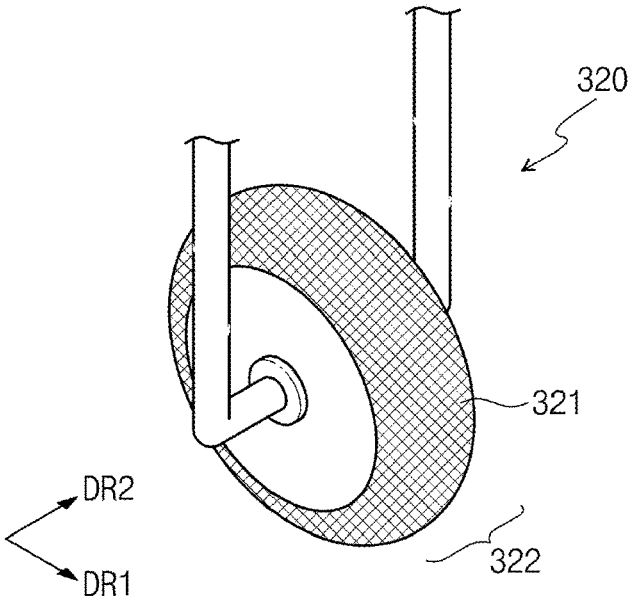
FIG. 4B is a perspective view illustrating a second machining wheel of FIG. 2.

FIG. 4A is a perspective view illustrating a first machining wheel 310 of FIG. 2, and FIG. 4B is a perspective view illustrating a second machining wheel 320 of FIG. 2.

The machining wheel 300 of FIG. 2 includes the first and second machining wheels 310 and 320. The first machining wheel 310 includes first abrasive grains 311 and a first contact surface 312. The second machining wheel 320 includes second abrasive grains 321 and a second contact surface 322.

The first abrasive grains 311 and the second abrasive grains 321 include an abrasive for grinding the substrate 100. The abrasive includes a material having hardness greater than the hardness of the substrate 100, and includes alumina, corundum and diamond.

Comparing FIGS. 4A and 4B, the first abrasive grains 311 are greater in size than the second abrasive grains 321. Since the first abrasive grains 311 are greater than the second abrasive grains 321, the first machining wheel 310 has better cutting force than the second machining wheel 320. Since the second abrasive grains 321 are smaller than the first abrasive grains 311, the second machining wheel 320 may perform more fine grinding than the first machining wheel 310. Thus, it is preferred to grind the foldable part FA by using the first machining wheel 310 having better cutting force (S210) and then using the second machining wheel 320 capable of fine grinding (S220).

Contact surfaces 312 and 322 of the first and second machining wheels 310 and 320 contact the substrate 100, thereby grinding the surface 100. The contact surfaces 312 and 322 are not limited in shapes, and have at least one radius of curvature defined in a plane perpendicular to the first direction DR1. The curvature of radius of the groove 110 is determined by the radii of curvature of the contact surfaces 312 and 322. The first and second machining wheels 310 and 320 may have the same size and radius of curvature, or may have different size and radius of curvature from each other.

Figure 5:
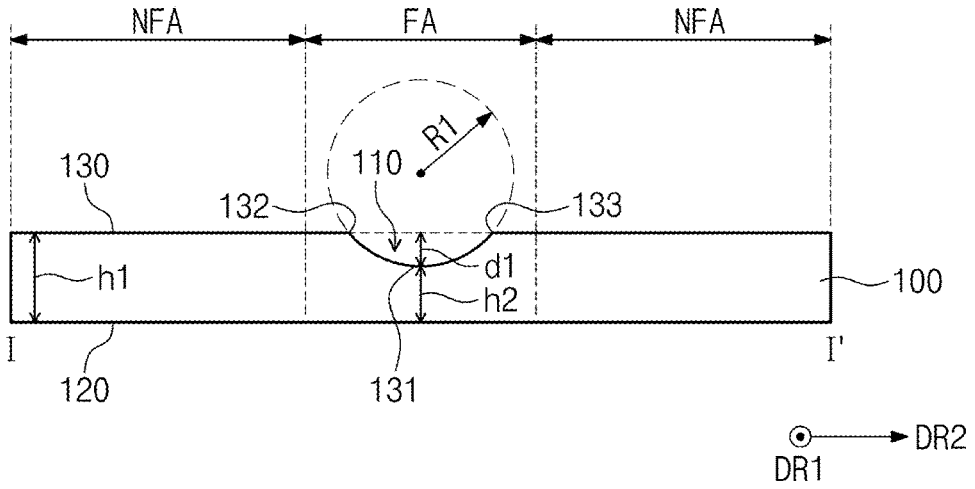
FIGS. 5, 6, 7, 8, 9, and 10 are cross-sectional views taken along line I-I' of FIG. 2 to illustrate forming a groove on a substrate.

FIG. 5 is a cross-sectional view taken along line I-I' of FIG. 2 and illustrating an embodiment of grinding the foldable part FA using the first machining wheel 310 (S210).

The contact surface 312 of the first machining wheel 310 has a first radius of curvature R1 defined in a plane perpendicular to the first direction DR1. The grinding of the foldable part FA using the first machining wheel 310 (S210) forms a first grinding surface 131 having the first radius of curvature R1 on the foldable part FA. The first machining wheel 310 forms a first edge 132 on one end of the first grinding surface 131, and a second edge 133 on the other end.

The grinding of the foldable part FA using the first machining wheel 310 (S210) determines a minimum thickness h2 of the foldable part FA. Difference between thickness h1 of the flat part NFA and the minimum thickness h2 of the foldable part FA is defined as a maximum depth d1 of the groove 110.

Figure 6:
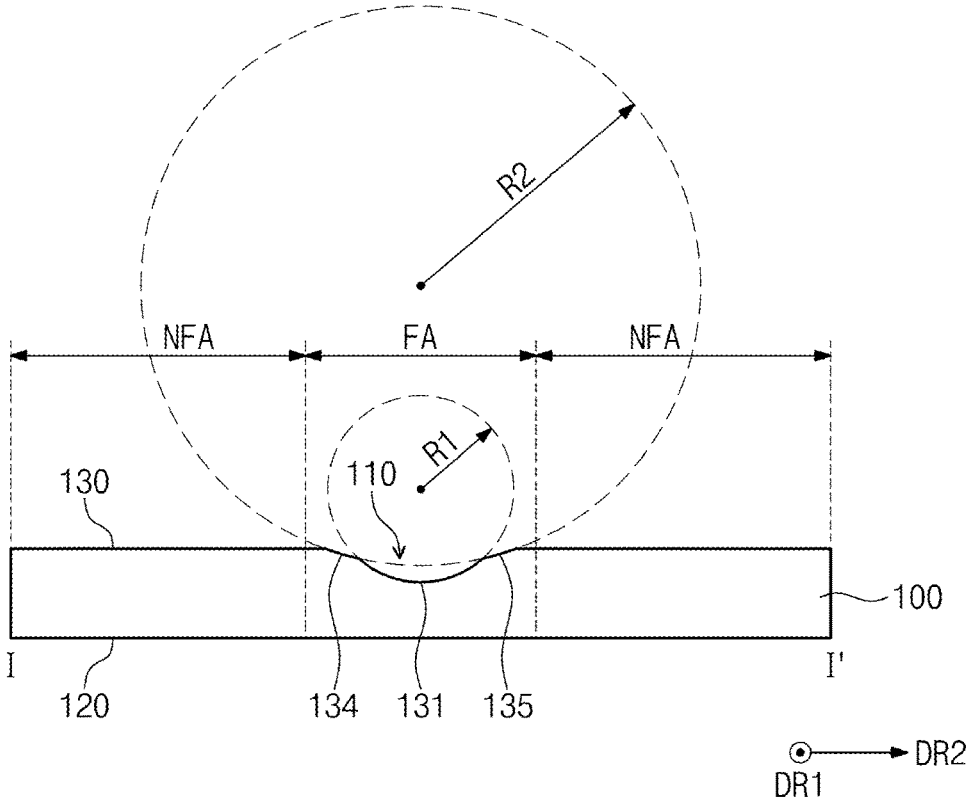

FIG. 6 is a cross-sectional view taken along line I-I' of FIG. 2 and illustrating an embodiment of the grinding the foldable part FA using the second machining wheel 320 (S220).

A contact surface 322 of the second machining wheel 320 has a second radius of curvature R2 greater than the first radius of curvature R1 defined in a plane perpendicular to the first direction DR1. The grinding of the foldable part FA using the second machining wheel 320 (S220) is grinding the first and second edges 132 and 133 to form second and third grinding surfaces 134 and 135 having the second radius of curvature R2 on the foldable part FA, respectively.

Since the second machining wheel 320 has the second radius of curvature R2 greater than the first radius of curvature R1, the second and third grinding surfaces 134 and 135 may be formed by one grinding operation. That is, the second and third grinding surfaces 134 and 135 have the same center of curvature.

Since the second machining wheel 320 grinds the first and second edges 132 and 133 to form the second and third grinding surfaces 134 and 135, the groove 110 may be easily machined in a curved shape through the machining by using a polishing wheel (S230) which will be described later.

Figure 7:
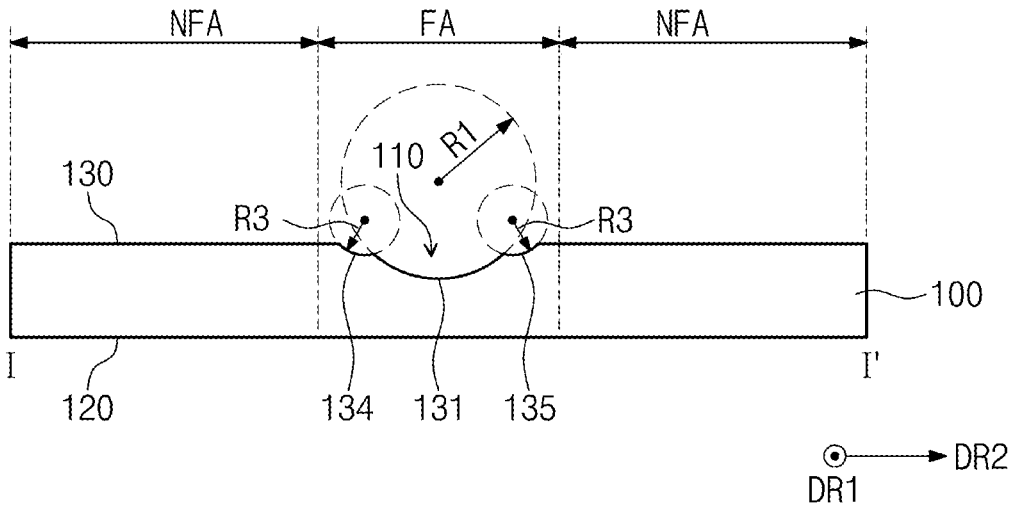

FIG. 7 is a cross-sectional view taken along line I-I' of FIG. 2 and illustrating another embodiment of the grinding the foldable part FA using the second machining wheel 320 (S220).

The contact surface 322 of the second machining wheel 320 has a third radius of curvature R3 less than the first radius of curvature R1 defined in a plane perpendicular to the first direction DR1. The grinding the foldable part FA by using the second machining wheel 320 (S220) is grinding the first edge 132 to form a second grinding surface 134 having the third radius of curvature R3, and is grinding the second edge 133 to form the third grinding surface 135 having the third radius of curvature R3.

Since the second machining wheel 320 has the third radius of curvature R3 less than the first radius of curvature R1, the second and third grinding surfaces 134 and 135 may be respectively formed through different steps of grinding. That is, the second and third grinding surfaces 134 and 135 have different center of curvature from each other.

Since the second machining wheel 320 grinds the first and second edges 132 and 133 to form the second and third grinding surfaces 134 and 135, the groove 110 may be easily machined in a curved shape through the machining by using the polishing wheel (S230) which will be described later.

Figure 8:
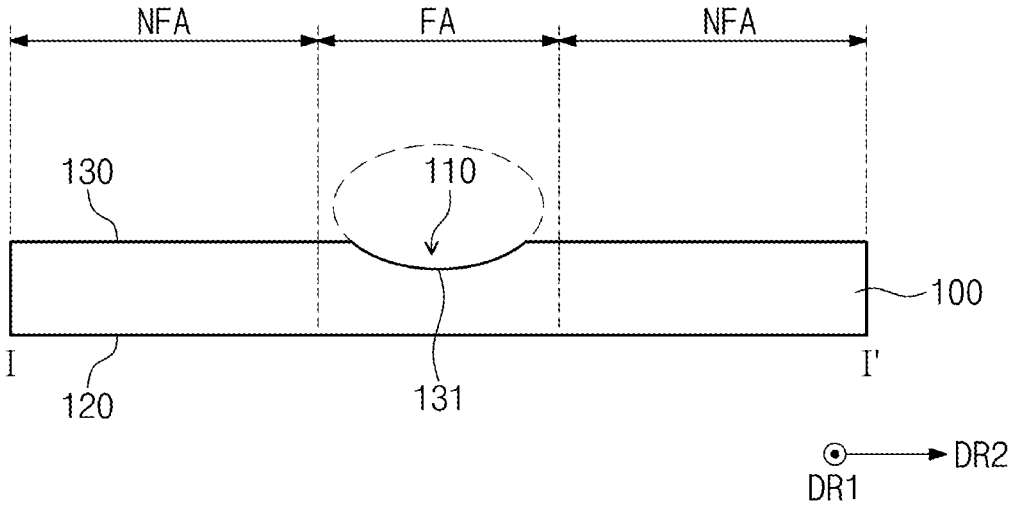

FIG. 8 is a cross-sectional view taken along line I-I' of FIG. 2 and illustrating another embodiment of grinding the foldable part FA using the first machining wheel 310 and/or the second machining wheel 320 (S210 and S220).

The respective contact surfaces 312 and 322 of the first machining wheel 310 and/or the second machining wheel 320 may have a plurality of radii of curvature defined in a plane perpendicular to the first direction DR1. In FIG. 8, an ellipse having the plurality of radii of curvature is illustrated as an example.

When the plurality of radii of curvature are provided, the foldable part FA may easily have a desired shape of the groove 110. Also, the groove 110 may be easily machined in a curved shape through the machining by using the polishing wheel (S230).

The first and second machining wheels 310 and 320 may have the same shape. In this case, the grinding of the foldable part FA by using the first machining wheel 310 (S210) is grinding the groove 110 roughly, and the grinding the foldable part FA using the second machining wheel 320 may be finely polishing the groove 110.

Figure 9:
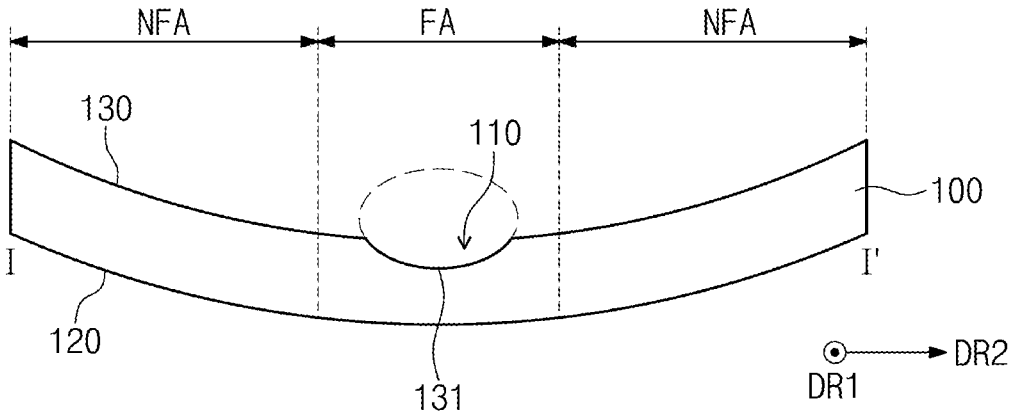

FIG. 9 is a cross-sectional view taken along line I-I' of FIG. 2 and illustrating another embodiment of the grinding of the foldable part FA by using the first machining wheel 320 and/or the second machining wheel 320 (S210 and/or S220).

The substrate 100 is illustrated to be flat in FIGS. 5 to 8, but may have a curved shape as illustrated in FIG. 9.

Particularly, the substrate 100 may have a curved shape with respect to an axis extending in the first direction DR1. The substrate 100 may have a curved shape such that right and left portions of the first surface 120 are closer to each other than the right and left portions of the second surface 130. FIG. 9 depicts an alternative case in which right and left portions of the second surface 130 are closer to each other than the right and left portions of the first surface 120.

Corresponding to the curved shape of the substrate 100, the stage 200 may have a curve on a contact surface with the first surface 120 to correspond to the curved shape of the first surface 120.

Figure 10:
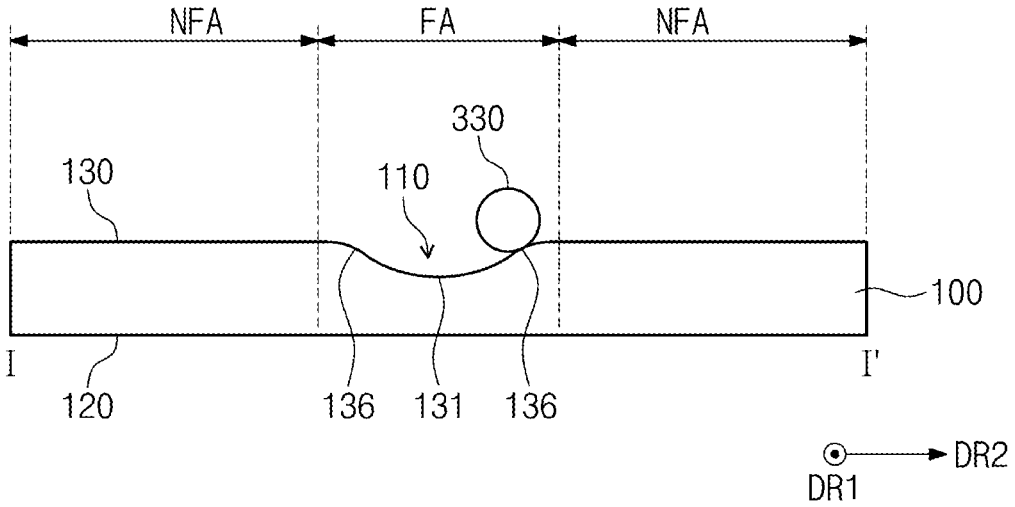

FIG. 10 is a cross-sectional view taken along line I-I' of FIG. 2 and illustrating an embodiment of the machining by using a polishing wheel 330 (S230).

Grinding the foldable part FA by using the first machining wheel 310 (S210) and grinding the foldable part FA using the second machining wheel 320 (S220) form an edge on the foldable part FA. When the edge is formed on the substrate 100, light incident on the edge may be irregularly emitted. The machining by using the polishing wheel 330 (S230) is machining the edge of the foldable part FA in a smooth curved surface 136 such that light is regularly emitted.

A material for the polishing wheel 330 is not limited a specific material, but a stretchable or malleable material may be suitable as a material for abrasive grains in order to machine a smooth curve. The polishing wheel 330 may rotate about the second direction DR2 intersecting the first direction DR1 as a rotation axis, and may rotate about the first direction DR1 as a rotation axis. The smooth curved surface 136 may have at least one radius of curvature defined in a plane perpendicular to the first direction DR1.

Figure 11:
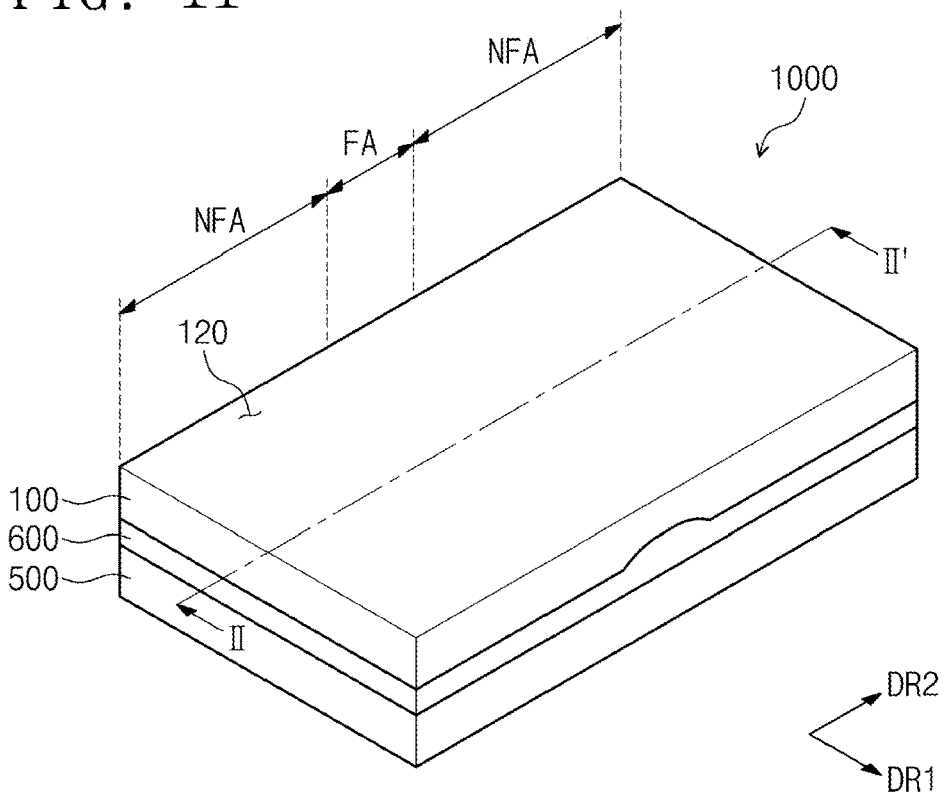
FIG. 11 is a perspective view illustrating an embodiment of attaching a display panel.
Figure 12:
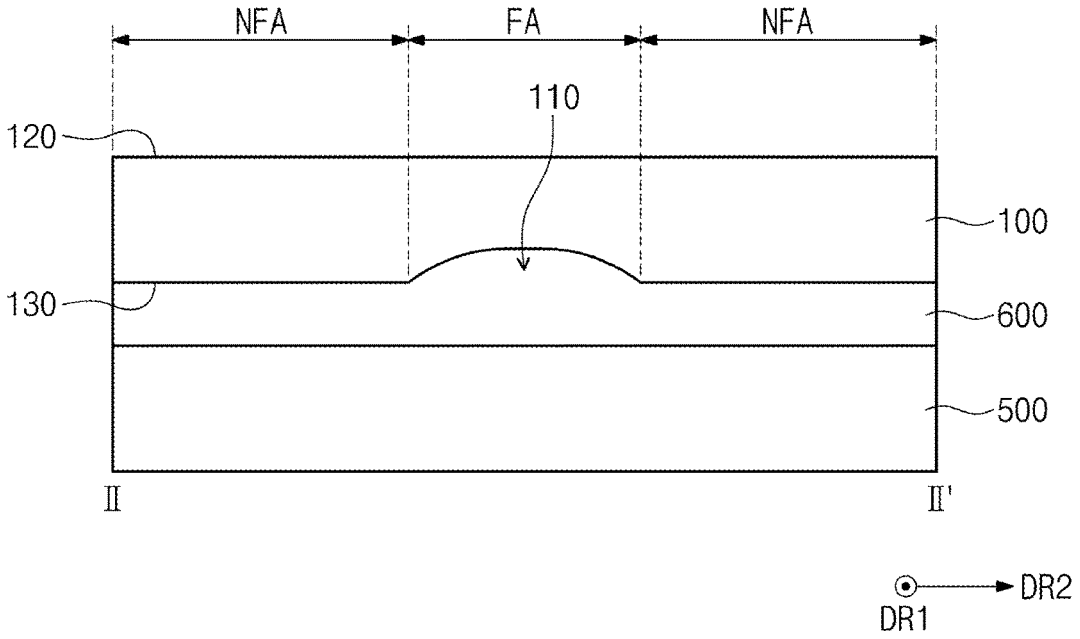
FIG. 12 is a cross-sectional view taken along line II-II' of FIG. 11 to illustrate an embodiment of attaching a display panel.

FIG. 11 is a perspective view illustrating an embodiment of attaching a display panel 500 (S500), and FIG. 12 is a cross-sectional view taken along line II-IF of FIG. 11 and illustrating an embodiment in which the display panel 500 is attached (S500).

The display panel 500 is configured to display an image. The display panel 500 may be a self-emitting display panel, such as an organic light emitting display panel. Alternatively, the display panel 500 may display an image using surrounding light without emitting light. For example, the display panel 500 may be any one among a liquid display panel, an electrophoretic display panel and an electrowetting display panel.

Referring to FIGS. 11 and 12, the display panel attaching process (S500) may involve attaching the display panel 500 such that the second surface 130 is closer to the display panel 500 than the first surface 120. That is, the groove 110 may be provided between the display panel 500 and the substrate 100.

When the display panel 500 is attached such that the second surface 130 is closer to the display panel 500 than the first surface 120, the manufacturing method of the display apparatus 1000 may further include filling the groove 110 with a buffering member 600. The filling the buffering member 600 may be filling the buffering member 600 between the substrate 100 and the display panel 500, thereby bonding the substrate 100 to the display panel 500. The buffering member 600 may include a pressure sensitive adhesive (PSA) or an optically clear adhesive (OCA) having adhesion. The buffering member 600 may be transparent.

When light passes through two materials having different refractive indexes, refraction of light may occur. The substrate 100 and the buffering member 600 may have the same refractive index. In this case, an image by the display panel 500 is not distorted by the substrate 100 and the buffering member 600.

The first surface 120 may form an outer surface of the display apparatus 1000. Since the first surface 120 is flat, and the buffering member 600 is inside the groove 110 provided between the second surface 130 and the display panel 500 to prevent refraction of light, the substrate 100 may not affect optical characteristics.

Figure 13:
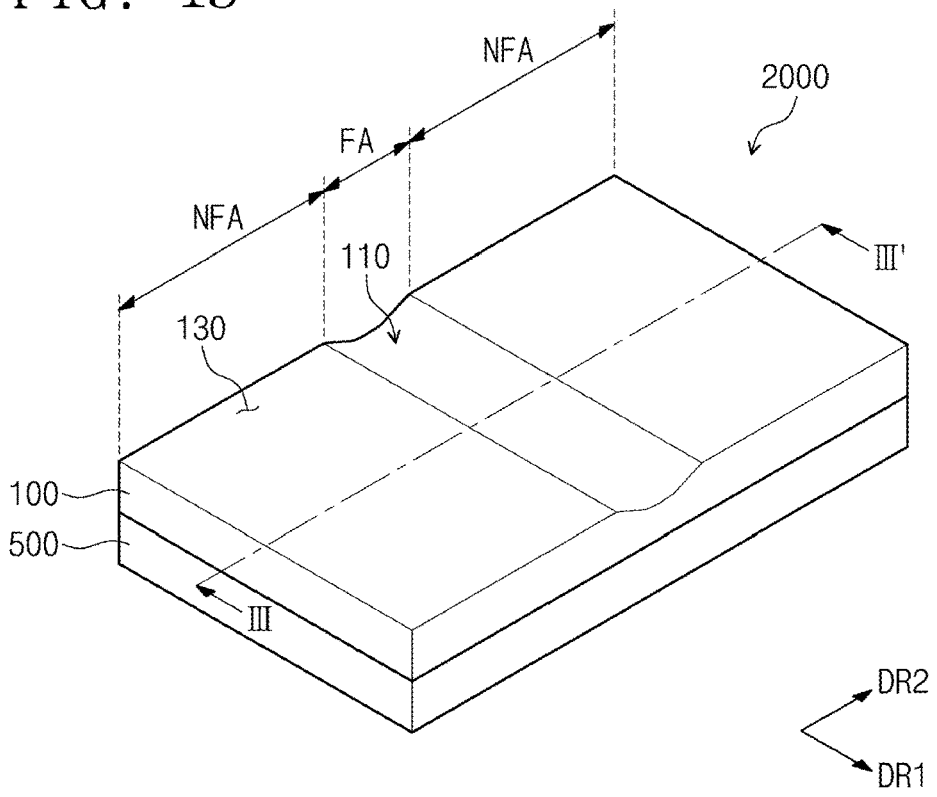
FIG. 13 is a perspective illustrating another embodiment of attaching a display panel.

FIG. 13 is a perspective view illustrating another embodiment of the attaching the display panel 500 (S500). Referring to FIG. 13, the attaching the display panel 500 (S500) may attach the display panel 500 such that the first surface 120 is more closely provided to the display panel 500 than the second surface 130. That is, the groove 110 may be provided on the substrate 100.

Although not illustrated, when the display panel 500 is attached such that the first surface 120 is closer to the display panel 500 than the second surface 130, the manufacturing method of a display apparatus 2000 may further include the filling the buffering member 600 between the first surface 120 and the display panel 500. The buffering member 600 may include a pressure sensitive adhesive (PSA) or an optically clear adhesive (OCA). The buffering member 600 may be transparent.

The second surface 130 may form an outer surface of the display apparatus 2000. Unlike the display apparatus 1000 of FIG. 11, the display apparatus 2000 of FIG. 13 is provided with a groove 110 on an outer surface of the display apparatus 2000. With this embodiment, an image by the display panel 500 may be distorted. Specifically, light may be refracted by the groove 110.

Figure 14:
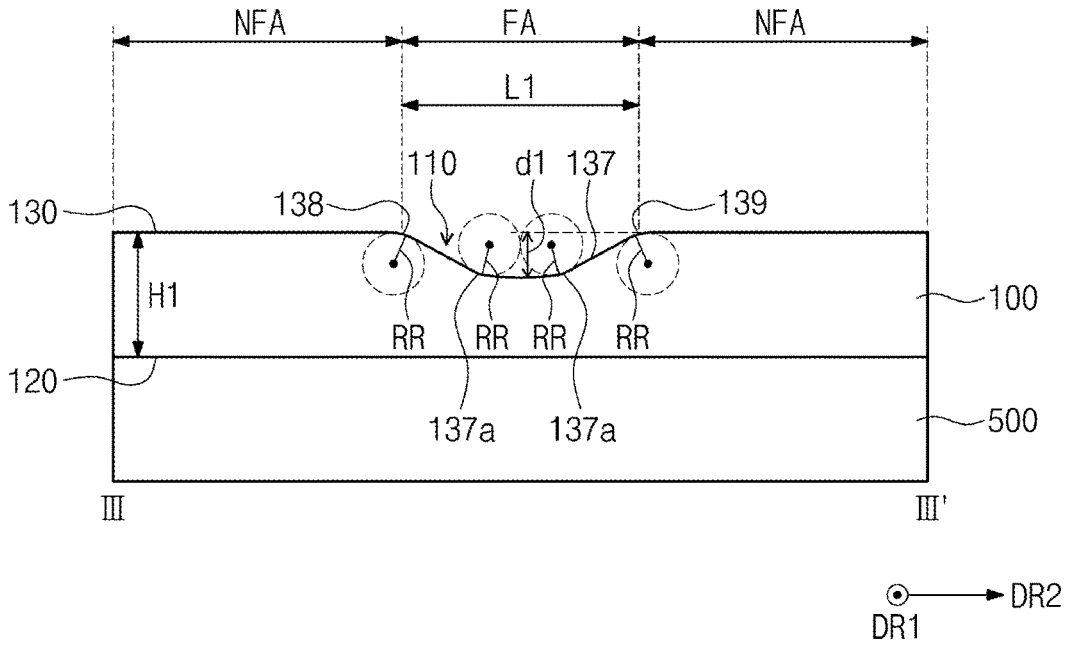
FIG. 14 is a cross-sectional view of a display apparatus taken along line III-III' of FIG. 13.

FIG. 14 is a cross-sectional view of the display apparatus 2000 taken along line III-IIF of FIG. 13.

Referring to FIG. 14, the second surface 130 of the substrate 100 includes a groove surface 137 forming the groove 110. The groove surface 137 has a plurality of radii of curvature defined in a plane perpendicular to the first direction DR1. The groove surface 137 includes a first end 138, a second end 139 facing the first end 138, and an internal point 137*a* between the first end 138 and the second end 139. The first end 138 and the second end 139 are formed to have the minimum radius of curvature RR among a plurality of radii of curvature in the first direction DR1. The internal point 137*a* between the first end 138 and the second end 139 may be formed to have the minimum radius of curvature RR. FIG. 14 is illustrated such that two minimum radii of curvature RR are formed between the first end 138 and the second end 139, although the inventive concept is not limited thereto. In another embodiment, one minimum radius of curvature RR may be formed between the first end 138 and the second end 139. That is, the internal point 137*a* may be formed in plurality.

The groove surface 137 is not allowed to have a radius of curvature less than the minimum radius of curvature RR defined in a plane perpendicular to the first direction DR1. Since the groove surface 137 has the minimum radius of curvature RR between the first end 138 and the second end 139, the groove surface 137 forms the groove 110 having a gentle slope. When the groove 110 has a gentler slope, an angle between incident light and the groove surface 137 becomes closer to 90°, and little refraction of light y occurs. Thus, image distortion is not visibly observed. As shown in FIG. 14, when the minimum radius of curvature RR is formed at two points between the first end 138 and the second end 139, there is a center portion of the groove surface 137 that is substantially flat. When the center portion is flat, refraction of light is minimized, and image distortion may be prevented.

The substrate 100 needs to retain foldability and a desired level of impact resistance. Also, the machining of the groove 110 needs to be considered such that the image distortion is not visibly observed. Generally, in the case of the substrate 100 including glass, the thickness of the substrate 100 that can accommodate a 3 mm radius of curvature while the substrate 100 is folded is 50 μm. The thickness of the substrate 100 that can accommodate a 5 mm radius of curvature while the substrate 100 is folded may be 75 μm. The slimmed substrate 100 requires optimization of the width and depth of the groove 110.

Figure 15:
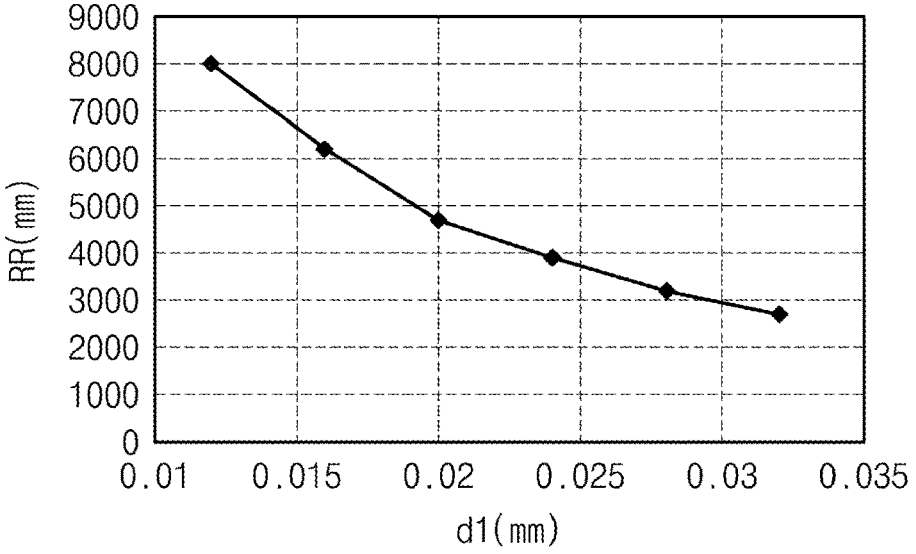
FIGS. 15, 16, and 17 are graphs illustrating simulation results of a groove for preventing image distortion from being visibly observed.
Figure 16:
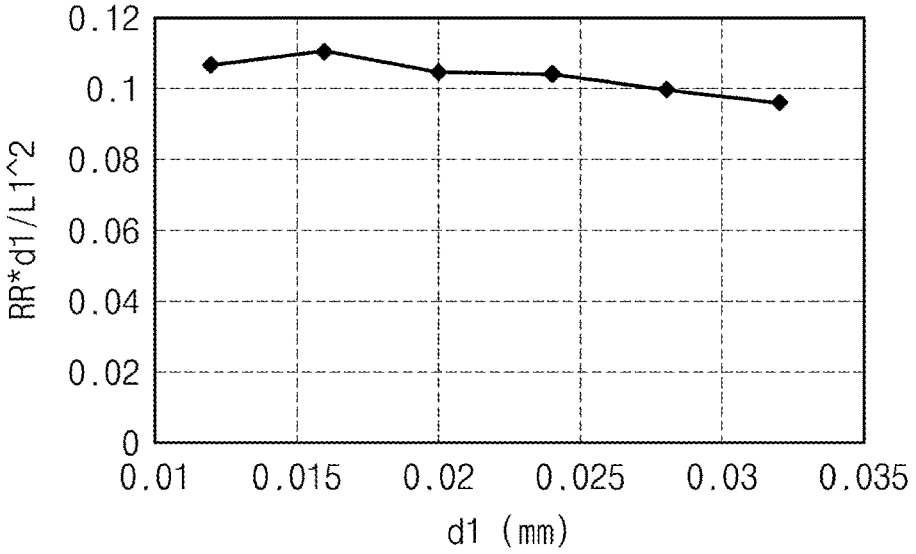
Figure 17:
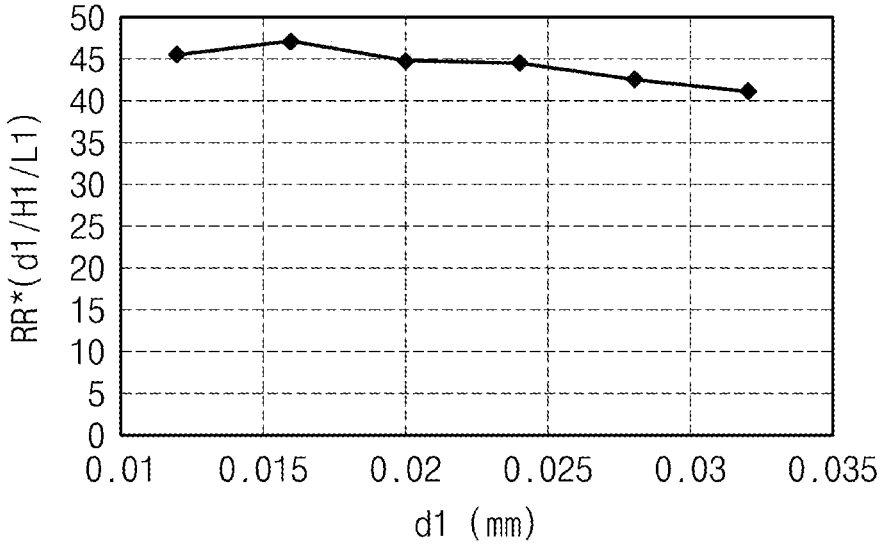

FIGS. 15 to 17 are graphs illustrating simulation results of a groove 110 for preventing image distortion from being visibly observed.

The width of the groove surface 137 in the second direction DR2 is defined as L1, the maximum depth of the groove 110 is defined as d1, the thickness of the flat part NFA is defined as h1, and the minimum radius of curvature is defined as RR.

FIG. 15 is a graph illustrating the minimum radius of curvature RR optimized to prevent image distortion from being visibly observed. When the minimum radius of curvature RR decreases, the slope of the groove 110 drastically changes, and thus possibility of image distortion increases. When the maximum depth d1 increases, the slope of the groove 110 drastically changes, and thus possibility of image distortion increases.

When values of FIG. 15 are connected and expressed in a function, the minimum radius of curvature RR is expressed as 1×107d12−735625d1+15222. Specifically, given that the maximum depth d1 is 0.02 mm, the image distortion is not visibly observed until the minimum radius of curvature RR arrives at 4500 mm. The image distortion is not visibly observed when the minimum radius of curvature RR is equal to 4500 mm or greater, but the width L1 in the second direction DR2 becomes wider, and thus the groove 110 may become vulnerable to impact.

Since the maximum depth d1 of the groove 110 is not allowed to be greater than the thickness h1 of the flat part NFA, the maximum depth d1 is preferably 0.01 mm to 0.05 mm inclusive. Consequently, the minimum radius of curvature may be 2 m to 10 m, inclusive.

FIG. 16 is a graph illustrating optimized value of RR×(d1/L12) with respect to the maximum depth d1 of the groove 110 to prevent image distortion from being visibly observed. FIG. 17 is a graph illustrating optimized value of RR×(d1/L1/h1) with respect to the maximum depth d1 of the groove 110 to prevent image distortion from being visibly observed.

When the width L1 of the groove surface 137 in the second direction DR2 increases, the minimum radius of curvature RR may increase, thus reducing the possibility of image distortion. However, the area on which the groove 110 is formed becomes wider, possibly making the groove 110 vulnerable to impact.

Referring to FIG. 16, value of RR×(d1/L1$^2$) is preferably 0.08 to 0.12 inclusive. Referring to FIG. 17, optimized value of RR×(d1/L1/h1) is 40 to 50 inclusive, and value of RR×(d1/L1/h1) is preferably 10 to 50 inclusive.

A window for a display apparatus, a manufacturing method thereof, and a manufacturing method of a display apparatus according to the inventive concept enable a foldable part to be machined slimly to prevent damage upon bending of the window. Further, the machined window is designed so as not to distort an image provided by the display panel.

The present disclosure is not limited to embodiments set forth herein, but will be apparent to those of ordinary skilled in the art that various changes and modifications may be made without departing from the technical spirit and scope of the present invention. Therefore, these modifications or changes should be construed as pertaining to the appended claims.

What is claimed is:

1. A window for a display apparatus comprising:

a foldable part bent along a first direction; and a flat part adjacent to the foldable part, wherein the foldable part comprises a groove surface providing a groove having a plurality of radii of curvature defined in a plane perpendicular to the first direction, the groove surface comprises one end contacting the flat part, an other end contacting the flat part and facing the one end, and an internal point between the one end and the other end, and each of the one end, the other end and the internal point has a minimum radius of curvature among the plurality of radii of curvature, and a width of the groove surface in a second direction intersecting the first direction is defined as L1, the maximum depth of the groove is defined as d1, a thickness of the flat part is defined as h1, and the minimum radius of curvature is defined as RR, wherein RR is 2 m to 10 m inclusive, d1 is 0.01 mm to 0.05 mm inclusive, RR×(d1/L1$^2$) is 0.08 to 0.12 inclusive, and RR×(d1/L1/h1) is 10 to 50 inclusive.

2. The window of claim 1, wherein the internal point comprises a first internal point and a second internal point spaced apart from the first internal point in a second direction intersecting the first direction, and each of the first internal point and the second internal point has the minimum radius of curvature.

3. The window of claim 2, wherein the groove surface corresponding to a line between the first internal point and the second internal point is flat.

4. The window of claim 1, wherein the flat part comprises a first flat part and a second flat part, and the foldable part is disposed between the first flat part and the second flat part.

5. The window of claim 1, wherein in a thickness direction of the flat part, a thickness of the flat part is greater than that of the groove.

6. The window of claim 1, wherein the flat part comprises an upper surface and a bottom surface facing the upper surface, and the groove surface has a shape recessed from the upper surface of the flat part.

* * * * *